US006129610A

United States Patent [19]

Stephens

[11] Patent Number: 6,129,610

[45] Date of Patent: Oct. 10, 2000

[54] POLISH PRESSURE MODULATION IN CMP TO PREFERENTIALLY POLISH RAISED FEATURES

[75] Inventor: Jeremy K. Stephens, Ossining, N.Y.

[73] Assignee: International Business Machines Corporation, Armonk, N.Y.

[21] Appl. No.: 09/134,718

[22] Filed: Aug. 14, 1998

[51] Int. Cl.[7] ..... B24B 1/00

[52] U.S. Cl. ..... 451/41; 451/36; 451/63; 451/160

[58] Field of Search ..... 451/41, 36, 63, 451/160, 164, 170, 285–290, 286, 304, 305, 307

[56] References Cited

U.S. PATENT DOCUMENTS

| | | |
|---|---|---|
| 4,270,316 | 6/1981 | Krämer et al. . |
| 4,313,284 | 2/1982 | Walsh . |
| 4,910,155 | 3/1990 | Cote et al. . |
| 4,918,869 | 4/1990 | Kitta . |
| 5,036,630 | 8/1991 | Kaanta et al. . |
| 5,104,828 | 4/1992 | Morimoto et al. . |
| 5,423,716 | 6/1995 | Strasbaugh . |
| 5,486,129 | 1/1996 | Sandhu et al. . |
| 5,486,265 | 1/1996 | Salugsugan . |
| 5,522,965 | 6/1996 | Chisholm et al. . |
| 5,647,792 | 7/1997 | Katsuoka et al. . |
| 5,722,879 | 3/1998 | Cronin et al. . |
| 5,769,697 | 6/1998 | Nishio . |
| 5,839,947 | 11/1998 | Kimura et al. . |

OTHER PUBLICATIONS

Teres ™CMP System—Linear Planarization Technology (LPT) Lam Research Bulletin 1998.

Linerar Planarization Technology ™On Track Systems Inc., Product Bulletin.

*Primary Examiner*—Timothy V. Eley
*Assistant Examiner*—Willie Berry, Jr.
*Attorney, Agent, or Firm*—Delio & Peterson, LLC; John J. Tomaszewski

[57] ABSTRACT

A chemical-mechanical planarization (CMP) process is provided whereby cyclical pressure means varies the force against the wafer and polishing pad during the planarizing operation with the planarizing pad specially defined to have a relaxation time which is correlated with the force cycle so that the planarizing is enhanced. The relaxation time of the pad is greater than the downward an/or upward force cycle time on the wafer or pad and provides a planarizing process wherein the height of the pad during planarization is intermediate between a decompressed pad position and a compressed pad position typically encountered in a conventional CMP process.

8 Claims, 4 Drawing Sheets

POLISH PRESSURE MODULATION IN CMP TO PREFERENTIALLY POLISH RAISED FEATURES

BACKGROUND OF THE INVENTION

1. Field of the Invention

The present invention relates to processing of semiconductor wafers such as slices of semiconductor silicon in electronic component fabrication and, more particularly, to an improved method and apparatus for planarizing the wafers in the chemical-mechanical planarization process in order to achieve a high degree of wafer planarity.

2. Problem to be Solved

In the manufacture of electronic components such as integrated circuits, wafer surface planarity is of extreme importance. Photolithographic processes are typically pushed close to the limit of resolution and it is essential that the wafer surface be highly planar so that the electromagnetic or other radiation used to create the integrated circuit may be accurately focused in a single level thus resulting in precise imaging over the entire surface of the wafer. Wavy, curved or wedge-shaped semiconductor disks result in lack of definition when, for example, a photosensitive resist is applied to the surface of the disk and exposed.

In order to achieve the degree of planarity required to produce ultra high density integrated circuits and other electronic component circuits, chemical-mechanical planarization processes are now typically employed in the industry. In general, the chemical-mechanical planariztion (CMP) process involves pressing a semiconductor wafer against a moving polishing surface that is wetted with a chemically reactive, abrasive slurry. Slurries are usually either basic or acidic and generally contain alumina or silica particles. The planarizing surface is typically a planar pad made of a relatively soft, porous material such as blown polyurethane. The pad is usually mounted on a planar rotatable platen but linear moving pads are also now being proposed as described below.

In general, the wafer is secured to a carrier plate (or wafer carrier)by a mounting medium such as an adhesive, with the wafer having a force load applied thereto through the carrier by a pressure plate so as to press the wafer into frictional contact with a planarizing pad mounted on a rotating or linear moving turntable. The carrier and pressure plate also rotate as the result of either the driving friction from the rotating turntable or rotation drive means directly attached to the pressure plate for a rotary turntable or linear turntable or linear moving pad.

In a typical planarization machine, the movement of the carrier is programmed to acquire a wafer from a first station, to transport the wafer to a planarizing surface, to drive the wafer across the rotating planarizing surface, to transport the wafer from the planarizing surface to a second station, and to release the wafer at the second station. A typical way of securing and releasing the wafer is by the use of a vacuum head that includes a rigid perforated plate against which the wafer is drawn by applying a vacuum to a plenum lying above the perforated plate.

During planarization it has been found that when a force is imposed on the wafer particularly when using a rotating pad and turntable the planarizing action across the wafer is not uniform causing center-to-edge non uniformity in thickness and poor flatness of the wafer. The surface life of the planarizing pad is also a factor in affecting the planarity of the planarized wafer. Frictional heat generated at the wafer surface enhances the chemical action of the planarizing fluid and thus increases the planarization rate. The frictional heat however can cause planarity problems unless the heat is evenly transmitted over the surface of the wafer and typical planarizing systems utilize cooling systems to control the temperature of the planarization operation.

A number of attempts have been made in the prior art to improve the planarity of CMP operations. In U.S. Pat. No. 4,270,316 the uneven transmission of pressure which causes different degrees of abrasion of the planarized disks is compensated for by the provision of soft elastic inserts placed between a pressure piston and the back of the carrier plate on which the disks to be planarized are cemented. In U.S. Pat. No. 4,313,284 a deformable thin disk carrier is mounted through a resilient device to a rotatable pressure plate so that the carrier can be deformed to either a concave shape or convex shape depending on the planarization required. In U.S. Pat. No. 4,910,155 a dam is provided on the planarizing plate so that the planarizing pool of slurry completely immerses the planarizing pad. In U.S. Pat. No. 4,918,869 the use of pressurized air acting on the pressure plate is provided so that the pressure on the wafer surface can be uniform. In U.S. Pat. No. 5,036,630 the wafer carrier comprises at least two (2) materials having different coefficients of thermal expansion which carrier imparts a desired convex or concave bias to the wafer during the planarizing operation. In U.S. Pat. No. 5,423,716 the lower face of the backing plate of the wafer carrier includes a number of recessed areas to which a vacuum can selectively be applied. The vacuum is applied to suck a resilient membrane into the recessed areas to draw the wafer into position. The same apparatus can be used to apply a pressurized fluid to the wafer to exert a uniform downward pressure on the wafer. In U.S. Pat. No. 5,486,129 the pressure head of the wafer carrier contains a number of pressure applicators over the wafer surface which can be monitored and adjusted to vary the pressure on the wafer during the planarizing operation.

In U.S. Pat. No. 5,486,265 uniform chemical-mechanical planarization is achieved at a high material removal rate by pulsing the pressure applied to the wafer undergoing planarization. The pressure is pulsed between an initial optimum pressure and a reduced second pressure, preferably about 0 psi so that the cleaning slurry reaches all portions of the wafer surface and eliminates the negative impact of starvation areas which do not have a sufficient amount of cleaning slurry.

In U.S. Pat. No. 5,522,965, a chemical-mechanical planarization method is disclosed wherein a non-rotating planarization pad is used and energy, e.g., ultrasonic energy, applied to the pad to aid in the removal of surface material from the wafer and for pad conditioning.

The disclosures of the above patents are hereby incorporated by reference.

The above described CMP process was mainly directed to the methods typically used in the industry today which are basically termed a rotary or orbital polishing technique. The limitations of such rotary or orbital techniques are becoming increasingly evident since the wafer is inherently exposed to unequal radial velocities on its surface during polishing. These velocities which increase along the radius of the polishing platen and pad cause removal rates to vary across the wafer surface.

The next generation CMP process may be a non-rotary type technique now labeled Linear Planarization Technology (LPT). This technique uses a linear belt polish pad and eliminates the unequal radial velocities encountered during orbital or rotary polishing. Such techniques as shown in an article entitled Linear Planarization Technology published by OnTrak Systems, Inc. LAM Research also describes this technique in an article entitled Teres™ CMP System Linear Planarization Technology(LPT) dated February 1998. In the LPT technology and in the rotary (orbital) technology, polishing pressure may be applied from underneath the polishing pad via fluid flow (air or water) or from above the polishing pad as is typically used in the rotary and orbital processes.

For convenience, the following description will be directed to rotary CMP processes and to such processes where a polishing pressure is exerted on the wafer from above the pad but it will be appreciated to those skilled in the art that the method and apparatus of the invention may be used for other CMP processes.

Bearing in mind the problems and deficiencies of the prior art, it is therefore an object of the present invention to provide an improved apparatus, e.g., CMP apparatus, for planarizing semiconductor wafers and other workpieces.

It is another object of the present invention to provide an improved method for planarizing workpieces, e.g., wafers, using such planarizing devices as a CMP apparatus.

It is a further object of the invention to provide flat workpieces, including planarized semiconductor wafers, made using the improved method and apparatus of the invention.

Other objects and advantages of the present invention will be readily apparent from the following description.

SUMMARY OF THE INVENTION

The above and other objects, which will be apparent to those skilled in the art, are achieved in the present invention which is directed in a first aspect to a method for planarizing workpieces such as semiconductor wafers in a chemical-mechanical planarization process which comprises applying a cyclical downward and upward force to either the wafer which is pressed against a polishing pad or to the pad during planarization and correlating the cyclical force with the compressibility of the pad so that the height of the pad is maintained intermediate between a compressed position and a decompressed position as typically employed during a conventional prior art planarization process.

In another aspect of the invention, a method is provided for chemical-mechanical planarization of a substrate such as a semiconductor wafer comprising the steps of:

supplying a chemical-mechanical planarization apparatus comprising a rotating turntable or a linear moving platen and a compressible planarizing pad on the surface thereof, the compressible pad having a relaxation time in seconds defined as TR;

supplying a planarizing slurry on the surface of the pad;

supplying a substrate to be planarized;

providing a cyclic downward and upward force to the substrate or to the pad to maintain the substrate against the surface of the pad during the application of the force so that the height of the pad during the application of the force is maintained intermediate between a decompressed height and a compressed height following the formula:

TR>THI and TLO wherein THI is the time the pad is subjected to the downward force and TLO is the time the pad is subjected to the upward force;

continuing the method until the substrate is planarized.

In an additional aspect of the invention an apparatus is provided for planarizing a surface on a workpiece such as a semiconductor wafer comprising:

a rotatable turntable or linear moving platen assembly;

a planarizing compressible pad supported on said assembly, the pad having a relaxation time in seconds defined as TR;

a rotatable carrier, located above said assembly and adapted to hold a workpiece during planarizing, with said workpiece secured on the lower surface of the carrier and positioned between said carrier and said planarizing pad;

means to provide a cyclic downward and upward force to the carrier and workpiece or to the pad whereby the height of the pad is maintained intermediate between a compressed position and a decompressed position during the planarization process.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
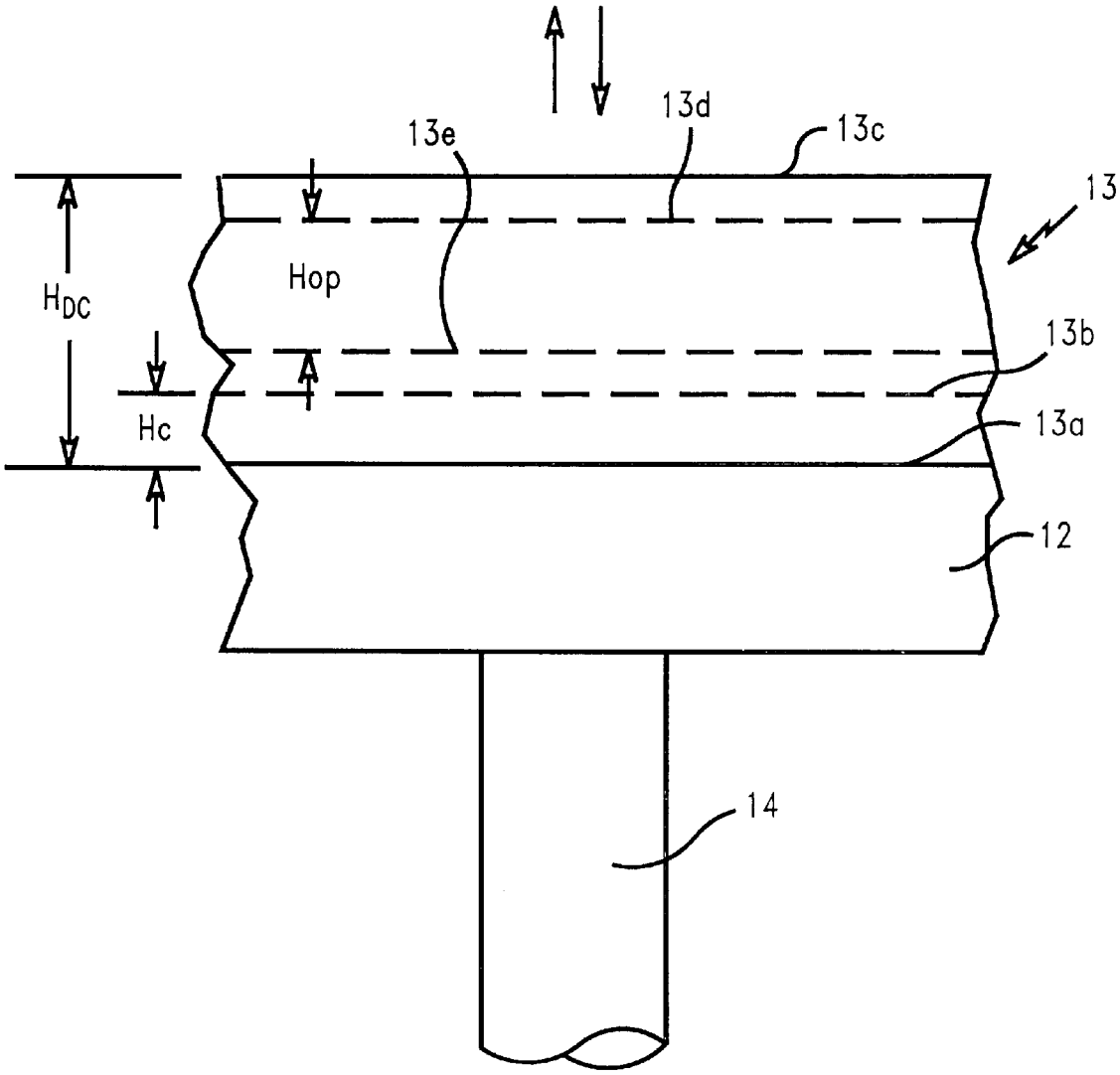
FIG. 1 is a schematic side view of a CMP rotatable turntable and planarizing pad assembly showing the different heights of the pad during a prior art planarization process and the planarization process of the invention.

In describing the preferred embodiment of the present invention, reference will be made herein to FIGS. 1–4 of the drawings in which like numerals refer to like features of the invention. Features of the invention are not necessarily shown to scale in the drawings.

Figure 3:
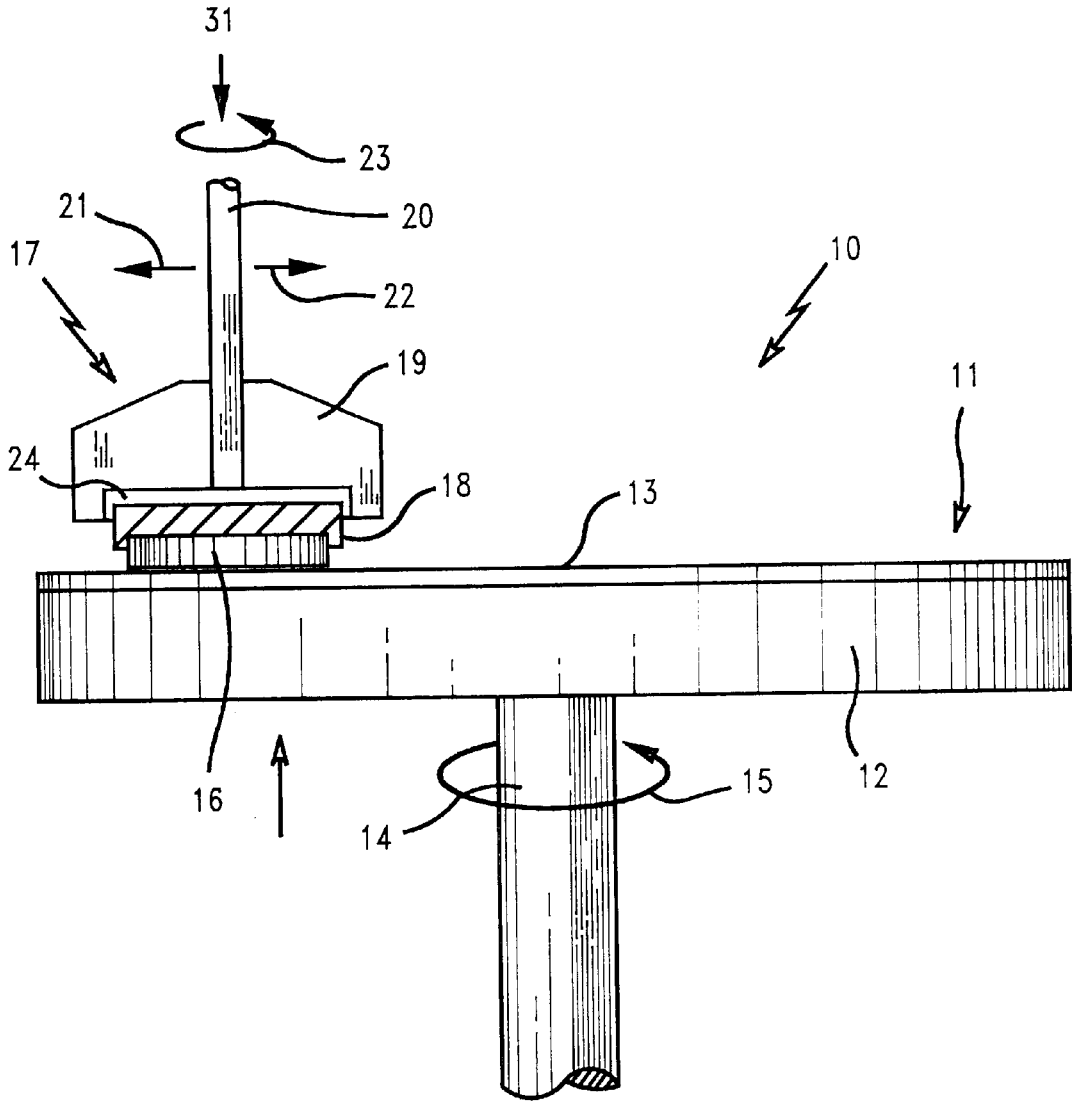
FIG. 3 (Prior Art)
FIG. 3 is schematic illustration of a typical prior art rotary CMP apparatus for planarizing a semiconductor wafer.

Referring to the drawings, FIG. 3 shows a prior art CMP rotary apparatus for planarizing a semiconductor wafer. The planarizing apparatus shown generally as 10 may be used in the method of the invention and includes a planarizing wheel assembly shown generally as 11. The planarizing wheel assembly includes a planarizing table or platen 12 to which is attached a compressible planarizing pad 13. The planarizing table 12 is rotated by shaft 14 in the direction indicated by arrow 15 by any suitable motor or driving means (not shown). The planarizing pad is typically a compressible polyurethane foam about 22 inch in diameter and 0.050 inch thick.

A wafer carrier assembly shown generally as 17 includes a wafer carrier 18 shown holding wafer 16. A pressure plate 19 is secured to the wafer carrier 18 for applying a force to the wafer carrier and wafer. In the embodiment shown, a hollow spindle 20 is coupled to the pressure plate and is driven by a suitable motor or driving means (not shown) for moving the wafer carrier assembly 17 in the directions shown by the arrows 21, 22 and 23. As shown by the arrow 31, pressure can be applied to the spindle 20 by a weight load and/or a pressurized fluid such as compressed air can be used to exert pressure on the upper surface of wafer carrier 18 by supplying the pressurized fluid to space 24 of the wafer carrier assembly. The force is essentially uniform over the surface of the wafer carrier and wafer.

During planarization, a slurry (not shown) is applied to the surface of the pad 13 and flows between the wafer 16 carried by the wafer carrier assembly 17 and the planarizing pad 13 of planarizing wheel assembly 11. Due to the force which is imposed on the wafer carrier 17 and its rotation and movement over the surface of the planarizing wheel assembly, the side of the wafer 16 contacting the planarizing pad 13 is planarized. As discussed hereinabove, due to a number of factors such as overheating, increased slurry at particular portions of the wafer, different rotational speeds at different parts of the wafer, etc., the planarized wafers are typically non-planar, and may have one or more of the following characteristics: thick outer edge of wafer; load uniformity within the chip; overall poor cross-wafer uniformity; and inconsistent planarization rate wafer to wafer.

As it is well known in the art, multiple wafers and/or multiple wafer carriers can be simultaneously processed on a single planarizing turntable during a planarizing operation.

Figure 4:
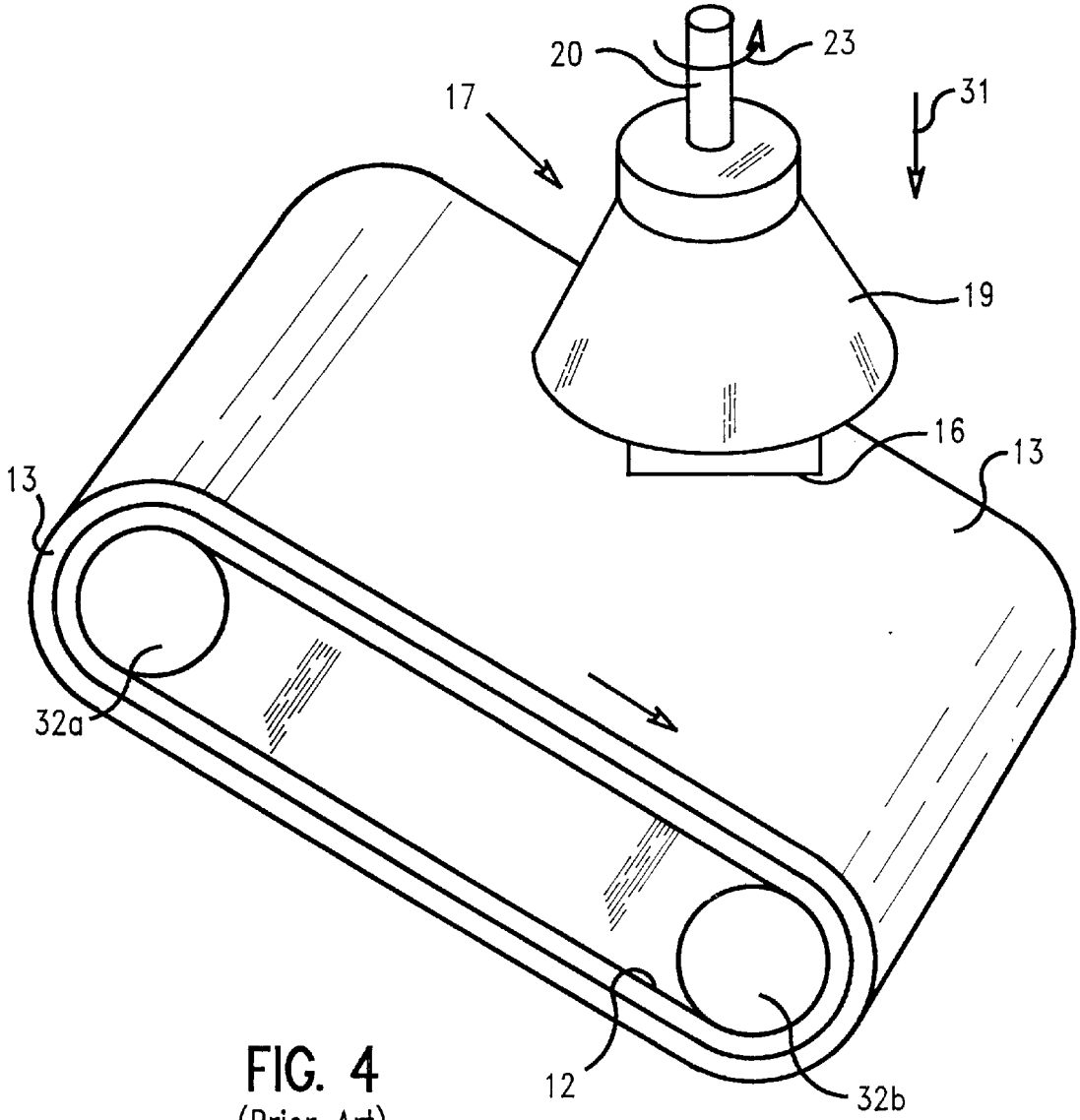
FIG. 4 (Prior Art)
FIG. 4 is a schematic of a typical prior art linear CMP apparatus for planarizing a semiconductor wafer.

Referring to FIG. 4, a linear pad CMP apparatus for planarizing a semiconductor wafer is shown. The pad 13 is moved linearly on platen 12 which is moved in a linear direction by rotating members 32*a* and 32*b* in the direction of the arrow. Similarly to the wafer carrier assembly 17 shown in FIG. 3, a wafer carrier assembly 17 is shown in position to be moved downward in the direction of arrow 31 to contact the linear pad moving surface 13. The wafer carrier assembly comprises a spindle 20 coupled to a pressure plate 19 and is preferably driven by a suitable motor or driving means (not shown) for moving the wafer carrier assembly in the directions shown by arrow 23. Wafer 16 is held by pressure plate 19 and when the wafer carrier assembly is moved in the direction of arrow 31 will contact the surface of linear moving pad 13.

The present invention is based on the discovery that the planarization of wafers using the chemical-mechanical planarization process may be significantly improved if a cyclical force having a vertical upward and downward direction is applied to the wafer or the polishing pad and consequently onto the pad and that the period or cycle time of the cyclical force be correlated with the compressibility of the pad. Broadly stated, the process comprises applying the cyclical force to the wafer or pad and consequently to the pad and using a pad having a defined compressibility so that during steady state operation of the planarization process the height of the pad is maintained between a compressed and decompressed height as such heights are achieved using prior art CMP processes. Accordingly, it is important to correlate the cyclic upward and downward force applied to the wafer and the pad with the compressibility of the pad which determines the relaxation time (TR) of the pad. The relaxation time (TR) of the pad may be defined as the time necessary for a compressed pad to return to its decompressed position or decompressed pad to be compressed to a particular height. Thus, if a downward force is applied to the pad compressing the pad and then the force removed (no downward force on the pad but an upward force is generated by the resiliency of the pad to return to its decompressed position), the time it takes for the pad to return to its decompressed height from the compressed height is defined as the relaxation time (TR) of the pad.

The relaxation time (TR) of the pad may be determined by experimental means and will differ depending on the thickness of the pad, the material from which the pad is made, and other such pad properties. The relaxation time of the pad may be determined using an instrument such as a TecQuipment SM106 Creep Machine or a Nano Indenter made by Nano Instrument.

The relaxation time (TR) of the pad as noted above is correlated with the cyclic downward and upward force applied to the wafer and to the pad. The cyclic nature of the force may be defined as the time in which a downward force is applied to the pad (termed THI) and the time that a lower force, e.g., the force is essentially removed and an upward force from the resiliency of the pad is applied to the wafer (termed TLO). The sum of THI and TLO equals the cycle time of the cyclic force and may be termed TPM. Preferably, the force is applied in an equal periodic cycle so that THI will equal TLO. For such an equal cyclic force process the relaxation time (TR) for the pad is greater than THI and TLO. Broadly stated, the relaxation time (TR) of the pad will always be greater than the time at which the pad is under a downward force (compression) or under an upward force (decompression).

Referring now to FIG. 1, the different stages of pad compression (decompression) may be demonstrated. A pad 13 is shown positioned on a platen 12 which is connected to a rotating shaft 14. The following description will also apply to a linear moving pad. The pad 13 has a lower surface 13*a* which is positioned on the upper surface of platen 12 and an upper decompressed surface 13*c*. In the decompressed position of the pad shown as 13*c* the height of the pad may be defined as $H_{DC}$. Under compression, as shown by the downward arrow, the pad is compressed to a height as indicated by line 13*b* and may be defined by $H_C$. The height $H_C$, and the other heights defined above will be the same regardless if the cyclic force is applied to the pad from above as shown in FIG. 1 or from below.

In a typical chemical-mechanical planarization process, the pad 13 will be compressed during steady state operation to a height indicated by line 13*b* and this compression maintained during the chemical-mechanical planarization method. In a process as shown in U.S. Pat. No. 5,486,265, supra, when the pressure is pulsed between an initial optimum pressure and a reduced second pressure, the pad will vary between a compressed position is shown by line 13*b* and a decompressed position shown as line 13*c*.

Applicant has discovered that the chemical-mechanical planarization process may be significantly enhanced if a cyclic downward and upward force is imposed on the wafer or pad and consequently on the pad and the cyclic force is correlated to the relaxation time (TR) of the pad. Thus, as shown in FIG. 1, the method of the invention correlates such a cyclic force and a pad compressibility so that during steady state operation of the chemical-mechanical planarization process, the height of the pad is maintained intermediate between compressed height 13*b* and uncompressed height 13*c* as shown by dotted lines 13*d* and 13*e*. As shown in FIG. 1, the height of the pad between 13*d* and 13*e* may be defined as $H_{OP}$. It can be seen from the figure that the height of the pad is above the compressed height 13*b* and below uncompressed height 13*c*. Operation of the chemical-mechanical planarization process within this pad operating height range $H_{op}$ significantly improves the process and provides enhanced planarization results.

Figure 2A:
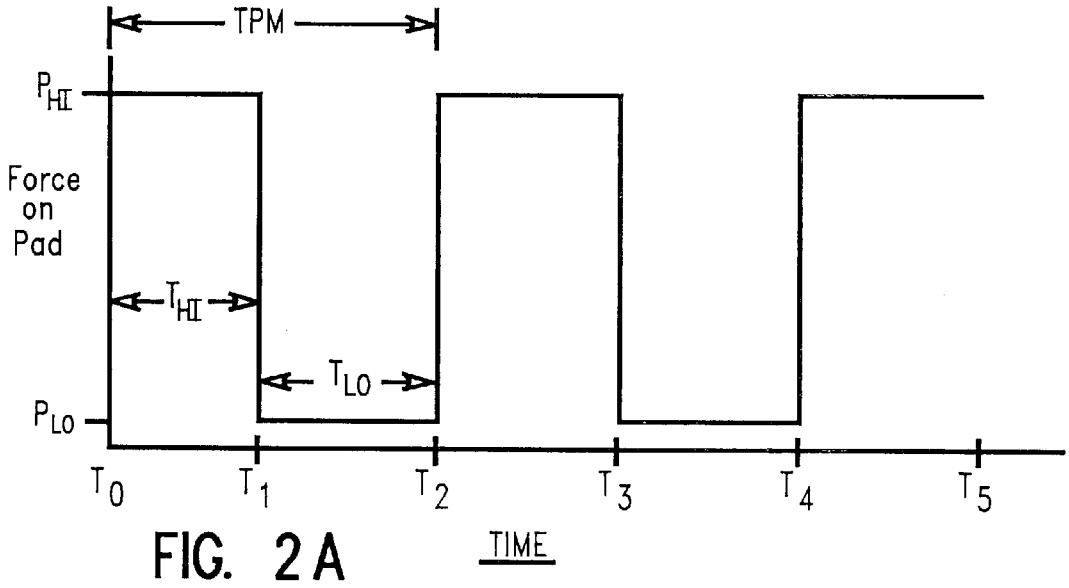
FIG. 2A is a graph showing the downward and upward force exerted on the pad by the wafer and wafer carrier assembly versus time during the CMP process.
Figure 2B:
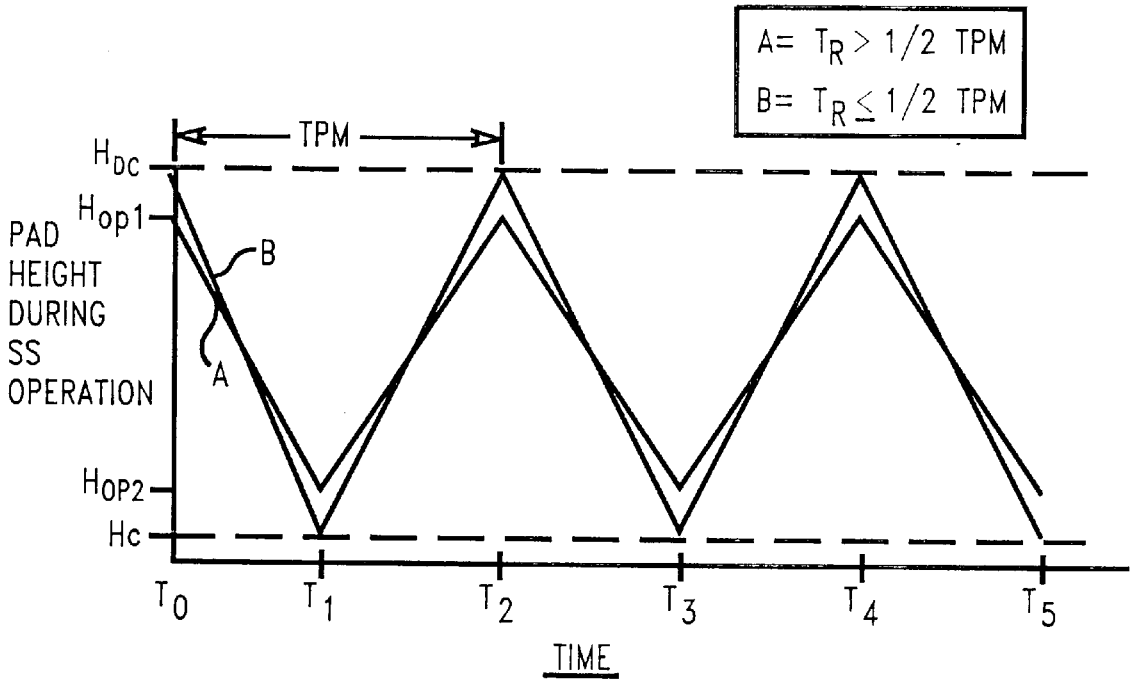
FIG. 2B is a graph showing the variation in pad height versus time during a prior art CMP process and during the CMP process of the present invention.

Referring now to FIGS. 2A and 2B, the method and apparatus of the invention may be demonstrated. FIG. 2A shows a graph wherein the force applied to the pad is measured against the time the pressure is applied to the pad. Thus, between time $T_0$ and $T_1$ (THI) the planarized force on the pad is a high compressive force where the pad is decompressing indicated as $P_{Hi}$. Between time $T_1$ and $T_2$ (TLO) the force on the pad is a low force where the pad is decompressing indicated as $P_{LO}$. The time period between $T_0$ and $T_2$ may be defined as $T_{PM}$ and indicates one cycle of the cyclic force applied to the pad. FIG. 2A is shown in a step function for clarity, however, it will be understood by those skilled in the art that the force is typically a sine type curve wherein the force is gradually imposed on the pad during compression of the pad or removed from the pad during decompression of the pad. For purposes of description, however, it is considered that the graphs as shown in FIGS. 2A and 2B will more clearly demonstrate the method and apparatus of the invention.

Referring now to FIG. 2B, a graph of the pad height during a steady state planarizing operation is shown in relation to time. The times indicated in FIG. 2B correspond to the times shown in FIG. 2A. Curve A shows the pad height moving from a height of Hop1 to a lower height Hop2 during THI (and $P_{HI}$) and then back to height Hopi during TLO (and $P_{LO}$) during a force cycle time $T_0$–$T_2$, which time interval represents one cycle of downward and upward force applied to the pad. It can be seen that pad height Hop1 and height Hop2 are less than the height of the pad in the decompressed state ($H_{Dc}$) and in the compressed state ($H_c$).

The planarizing process according to curve A is operational because the relaxation time (TR) of the pad is greater than the time that the pad is either under high force ($P_{HI}$) or low force ($P_{LO}$) as shown in FIG. 2A.

A conventional process using pressure modulation but without correlating the pad compressibility may be represented by curve B. Curve B shows that the height of the pad during planarization ranges between the uncompressed height of the pad ($H_{Dc}$)and the compressed height of the pad ($H_c$) when the relaxation time (TR) of the pad is less than the time that the pad is under high pressure or low pressure.

It will be appreciated by those skilled in the art that varying the time at which the pad is under high force (downward force) or low force (upward force) will affect the height of the pad between the compressed or decompressed positions, respectively, during steady operation of the processing. Assuming a uniform cyclic force modulation wherein the time that the pad is under high force or low force is equal, decreasing the force cycle (TPM) and/or using a pad with a higher relaxation time (TR) will decrease the variation in height of the pad during the process. Accordingly, Hop1 and Hop2 of curve A in FIG. 2B will move closer together so that a narrower pad height during operation will be obtained. Similarly, if the cycle time for force modulation is varied at a constant pad relaxation time (TR) which is greater than the downward or upward force time this will also affect the shape of curve A where increasing the cycle time will increase the difference in pad height between Hop1 and Hop2 whereas a decrease in the cycle time will decrease the height between Hopl an Hop2.

It will also be appreciated by those skilled in the art the cyclic force modulation can also be unequal so that the time at high force (THI) may be greater than or less than the time at low force (TLO). Regardless of the cycle time however, it will be appreciated that the relaxation time (TR) of the pad must still be greater than the period of time in which the pad is either under compression or decompression. In an unequal cyclic distribution of force, therefore, the limiting time will be the greater time that the pad is under high force or low force since this time must be less than the relaxation time (TR)of the pad.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for planarizing substrates in a chemical-mechanical planarization process wherein the substrate is forced against a moving compressible flat polishing pad that is wetted with an abrasive slurry to planarize the substrate and which pad has a decompressed height when no force is applied and a compressed height when a force is applied which comprises applying a cyclical downward and upward force to either the substrate which is pressed against the polishing pad or to the pad during planarization and correlating the amount of the cyclical force and the time the force is applied in the downward and upward direction with the compressibility of the pad so that the height of the pad during planarization is maintained intermediate between the compressed height and the decompressed height.

2. The method of claim 1 wherein the chemical-mechanical planarization process employs a rotating pad.

3. The method of claim 1 wherein the chemical-mechanical planarization process employs a linear moving pad.

4. The method of claim 1 wherein the workpiece is a semiconductor wafer.

5. A method for chemical-mechanical planarization of a substrate comprising the steps of:

supplying a chemical-mechanical planarization apparatus comprising a rotating turntable or a linear moving platen having a surface and a compressible flat planarizing pad on the surface thereof wherein a substrate is forced against the moving compressible flat planarizing pad that is wetted with an abrasive slurry to planarize the substrate and which pad has a decompressed height when no force is applied and a compressed height when a force is applied, the compressible pad having a relaxation time in seconds defined as TR wherein TR is defined as the time necessary for a compressed pad to return to its decompressed height and for a decompressed pad to be compressed to its compressed height;

supplying a planarizing abrasive slurry on the surface of the pad;

supplying a substrate to be planarized;

providing a cyclic downward and upward force to the substrate or to the pad to maintain the substrate against the surface of the pad during the application of the force so that the height of the pad during the application of the downward and upward force is maintained inter mediate between the decompressed height and the compressed height following the formula:

TR>THI and TLO wherein THI is the time the pad is subjected to the downward force and TLO is the time the pad is subjected to the upward force;

continuing the application of the cyclic downward and upward force until the substrate is planarized.

6. The method of claim 5 wherein the planarization apparatus employs a rotating turntable.

7. The method of claim 5 wherein the planarization apparatus employs a linear moving platen.

8. The method for claim 5 wherein the substrate is a semiconductor wafer.

* * * * *